US005592271A

United States Patent [19]

Parker et al.

[11] Patent Number: 5,592,271

[45] Date of Patent: Jan. 7, 1997

[54] DONOR ROLLS WITH CAPACITIVELY CUSHIONED COMMUTATION

[75] Inventors: Delmer G. Parker, Rochester; Gerald M. Fletcher, Pittsford, both of N.Y.

[73] Assignee: Xerox Corporation, Stamford, Conn.

[21] Appl. No.: 585,070

[22] Filed: Jan. 11, 1996

[51] Int. Cl.[6] ..... G03G 15/06

[52] U.S. Cl. ..... 399/285; 349/90

[58] Field of Search ..... 355/259, 261–262, 355/265, 245, 247–249; 118/647, 648, 651

[56] References Cited

U.S. PATENT DOCUMENTS

| | | | |
|---|---|---|---|
| 3,257,224 | 6/1966 | Jons | 117/17.5 |
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,172,170 | 12/1992 | Hays et al. | 355/259 |
| 5,220,383 | 6/1993 | Enoki et al. | 355/259 X |
| 5,268,259 | 12/1993 | Sypula | 430/311 |
| 5,289,240 | 2/1994 | Wayman | 355/259 |
| 5,337,124 | 8/1994 | Schmidlin et al. | 355/259 |
| 5,339,142 | 8/1994 | Hays | 355/259 |
| 5,394,225 | 2/1995 | Prker | 355/245 |
| 5,448,342 | 9/1995 | Hays et al. | 355/259 |
| 5,504,563 | 4/1996 | Hays | 355/261 |
| 5,515,142 | 5/1996 | Rommelmann | 355/259 |
| 5,517,287 | 5/1996 | Rodriguez et al. | 355/259 |

*Primary Examiner*—Matthew S. Smith
*Attorney, Agent, or Firm*—John S. Wagley

[57] ABSTRACT

A donor roll for transporting marking particles to an electrostatic latent image recorded on a surface is provided. The donor roll is adaptable for use with an electric field to assist in transporting the marking particles. The donor roll includes a rotatably mounted body. A portion of the body is electrically conductive. The donor roll also includes a dielectric layer mounted on a portion of the electrically conductive portion of the body. The donor roll also includes a first electrode member mounted on the body, adjacent the dielectric layer, and spaced from the electrically conductive portion of the body so that when the electric field is applied to the first electrode member a portion of the field will be transferred to the dielectric layer.

34 Claims, 11 Drawing Sheets

DONOR ROLLS WITH CAPACITIVELY CUSHIONED COMMUTATION

The present invention relates to a developer apparatus for electrophotographic printing. More specifically, the invention relates to a donor roll as part of a scavengeless development process.

Cross reference is made to United States Application No. (D/95042), entitled "Electroded Donor Roll Structure Incorporating Resistive Network", by Frank C. Genovese, filed concurrently herewith.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor).

Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al. U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto or may be present on the same photoreceptor such as in "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. The conductive brush is electrically connected with an electrically biasing source. The brush is typically a conductive fiber brush made of protruded fibers or a solid graphite brush. Typically only the electrode in the nip between the donor member and the developing surface is electrically biased. As the donor member rotates the electrode that now is in the nip needs to contact the brush. Since the distance between the nip and the developing surface is very small it is impractical to position the conductive brush in the nip. To accomplish the biasing of the donor member, the member must be extended beyond the developing surface. The donor member is typically an expensive complicated component that is very long and slender. U.S. Pat. No. 5,172,170 is herein incorporated by reference.

The use of a stationary position conductive brush in contact with the electrodes on the periphery of the donor member as a commutation method has many problems. The electrode potential difference required to form the powder cloud is in excess of 1,000 volts. The abrupt connection and disconnection of the brush with the respective electrode at these elevated voltages creates electrical noise and sporadic arcing between the brush and the electrode.

Many solutions have been attempted with various degrees of success in reducing the arcing and noise caused by the abrupt connection and disconnection of the brush with the respective electrodes. Some of the solutions have created new problems. For example, many materials for the contact brush have been considered including metal and non-metal materials. A carbon fiber brush and a solid graphite brush have been found to be most successful. A resistance graded carbon fiber brush with less resistance in the center of the brush and greater resistance on the ends of the brush has been used to slightly improve the abrupt connection and disconnection of the brush with the respective electrode. The use of rubbing contact in the brush causes commutation electrode wear which reduces the life of the donor roll. The arcing and the rubbing between the brush and the electrodes generates heat. Toner particles located near the commutating area tend to melt and coalesce in the commutating area creating lumps of toner which negatively affect the copy quality and the reliability of the machine. Also, when a carbon fiber brush is used, the fibers continually wear and become separated from the brush. These separated fibers contaminate the intricate workings of the machine. Furthermore, contamination, such as paper and clothing fibers, which enter the copy machine, may be become trapped between the brush and the electrodes causing premature failure. More complicated filtering systems may be required to separate the paper and clothing fibers as well as agglomerates from the toner. The electrical noise generated during the commutation causes developer pulsation and ripple which adversely affect the xerographic process and are detrimental to copy quality.

The following disclosures related to scavengeless and electroded rolls may be relevant to various aspects of the present invention:

U.S. patent application Ser. No. 08/376,585

Applicant: Rommelmann et al.

Filing Date: Jan. 23, 1995

U.S. patent application Ser. No. 08/339,614

Applicant: Rommelmann

Filing Date: Nov. 15, 1994

U.S. Pat. No. 5,394,225

Patentee: Parker (Prker)

Issue Date: Feb. 28, 1995

U.S. Pat. No. 5,289,240

Patentee: Wayman

Issue Date: Feb. 22, 1994

U.S. Pat. No. 5,268,259

Patentee: Sypula

Issue Date: Dec. 7, 1993

U.S. Pat. No. 5,172,170

Patentee: Hays et al.

Issue Date: Dec. 15, 1992

U.S. Pat. No. 4,868,600

Patentee: Hays et al.

Issue Date: Sep. 19, 1989

U.S. Pat. No. 3,996,892

Patentee: Parker et al.

Issue Date: Dec. 14, 1976

U.S. Pat. No. 3,980,541

Patentee: Aine

Issue Date: Sep. 14, 1976

U.S. Pat. No. 3,257,224

Patentee: Jons et al.

Issue Date: Jun. 21, 1966

U.S. application Ser. No. 08/376,585 discloses an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

U.S. application Ser. No. 08/339,614 discloses a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

U.S. Pat. No. 5,394,225 discloses a donor roll which has two sets of interdigitized electrodes embedded in the surface. An optical switching arrangement is located between a slip ring commutated by a brush and one set of interdigitized electrodes. The optical switching arrangement includes a photoconductive strip.

U.S. Pat. No. 5,289,240 discloses a donor roll which has two distinct set of electrodes along the periphery of the donor roll. The roll has a first set of electrodes that extend axially the length of the roll. The first set of electrodes includes groups of 1 to 6 electrodes which are electrically interconnected to each other and are commutated by contacting the filaments of a brush which is electrically interconnected to a biasing source. The roll also has a second set of electrodes that extend axially the length of the roll, are interconnected to each other, do not contact the brush, and are grounded.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulating core made of a phenolic resin. The donor roll core is coated with copper, coated with a photoresist, and exposed and etched to form longitudinal electrodes. The roll and electrodes are then overcoated with a semi-conductive rubber doped with carbon black.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

U.S. Pat. No. 3,257,224 discloses a developing apparatus including a trough to contain magnetizable developer and a magnetic roller. The roller transports the developer to an electrophotographic material and includes plates having a number of windings. The plates and windings are located inside the roll. The plates and windings serve as electromagnets to magnetically attract the developer so that it may be transported to the material.

SUMMARY OF THE INVENTION

According to the present invention there is provided a donor roll for transporting marking particles to an electrostatic latent image recorded on a surface. The donor roll is adaptable for use with an electric field to assist in transporting the marking particles. The donor roll includes a rotatably mounted body. A portion of the body is electrically conductive. The donor roll also includes a dielectric layer mounted on a portion of the electrically conductive portion of the body. The donor roll also includes a first electrode member mounted on the body, adjacent the dielectric layer, and spaced from the electrically conductive portion of the body so that when the electric field is applied to the first electrode member a portion of the field will be transferred to the dielectric layer.

According to the present invention, there is also provided a developer unit for developing a latent image with marking particles recorded on an image receiving member to form a developed image. The developer unit is adaptable for use with an electric field to assist in transporting the marking particles from the developer unit to the image receiving member. The developer unit includes a housing defining a chamber for storing at least a supply of marking particles therein and a movably mounted donor member. The member is spaced from the surface and adapted to transport marking particles from the chamber of the housing to a development zone adjacent the surface. The donor roll includes a body. A portion of the body is electrically conductive. The donor roll also includes a dielectric layer mounted on a portion of the electrically conductive portion of the body. The donor roll also includes a first electrode member mounted on the body, adjacent the dielectric layer, and spaced from the electrically conductive portion of the body so that when the electric field is applied to the first electrode member a portion of the field will be transferred to the dielectric layer.

According to the present invention, there is further provided an electrophotographic printing machine of the type having a developer unit adapted to develop with marking particles an electrostatic latent image recorded on an image receiving member. The developer unit is adaptable for use with an electric field to assist in transporting the marking particles from the developer unit to the image receiving member. The improvement includes a housing defining a chamber for storing at least a supply of marking particles therein and a movably mounted donor member. The member is spaced from the surface and adapted to transport marking particles from the chamber of the housing to a development zone adjacent the surface. The donor roll includes a body. A portion of the body is electrically conductive. The donor roll also includes a dielectric layer mounted on a portion of the electrically conductive portion of the body. The donor roll also includes a first electrode member mounted on the body, adjacent the dielectric layer, and spaced from the electrically conductive portion of the body so that when the electric field is applied to the first electrode member a portion of the field will be transferred to the dielectric layer.

IN THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
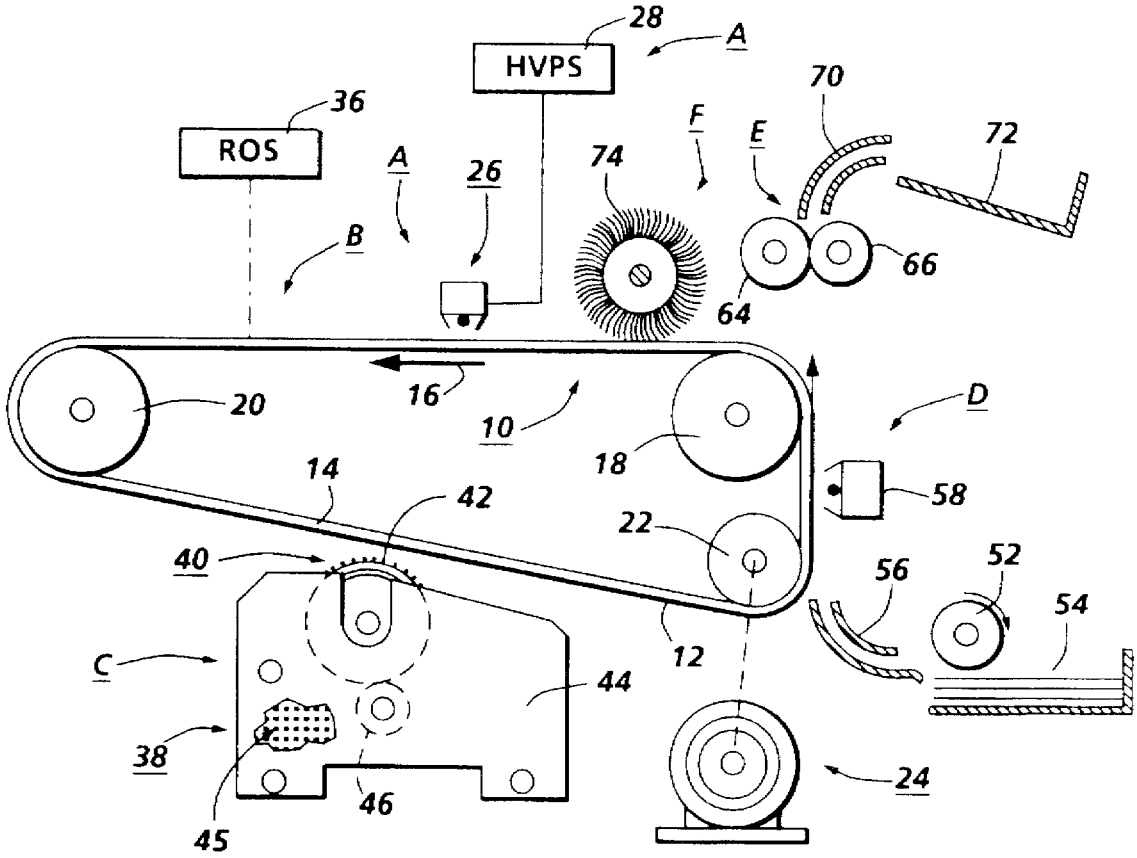
FIG. 2 is a schematic elevational view of a printing machine incorporating the capacitive coupled segmented donor roll of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. Preferably, development system 38 includes a donor roll or roller 40 and electrical conductors in the form of electrode wires or electrodes 42 positioned in the gap between the donor roll 40 and photoconductive belt 10. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet.

After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
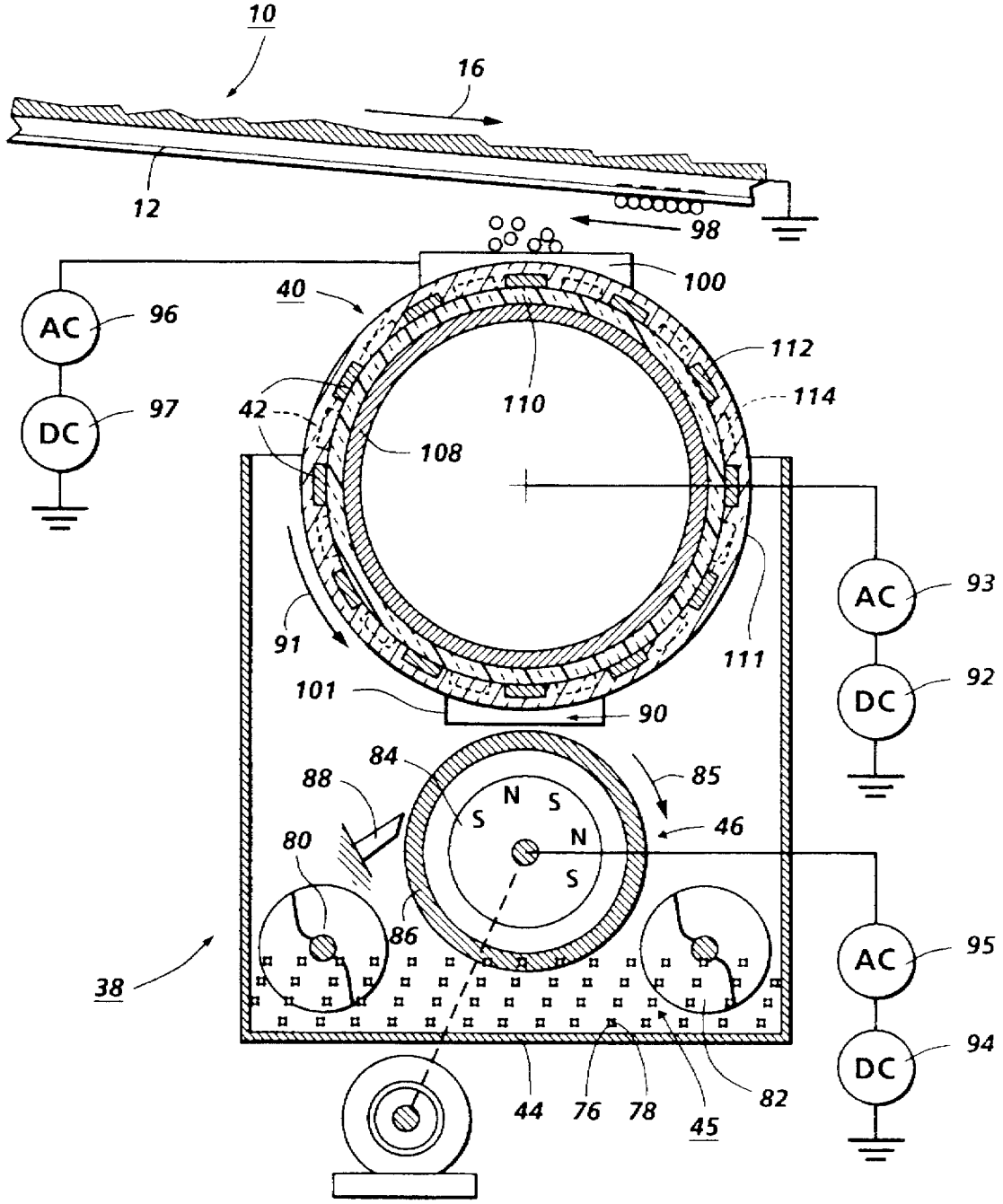
FIG. 3 is a schematic elevational view of a development unit incorporating the capacitive coupled segmented donor roll of FIG. 1.

Referring now to FIG. 3, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material designed to be rotated about the magnet 84 in a direction indicated by arrow 85. The magnetic field of the stationary multi-pole magnet 84 draws magnetic carrier granules 76, which are attached triboelectrically to the toner particles 78 to form the developer material 45 which includes magnetic carrier granules 76, toward the roll. The developer material 45 then clings to the exterior of the sleeve 86. As the sleeve 86 turns, the magnetic fields cause the developer material 45 including the carrier granules 76 to rotate with the rotating sleeve 86. This in turn enables a doctor blade 88 to meter the quantity of developer adhering to sleeve 86 as it rotates to a loading zone 90, the nip between transport roll 46 and donor roll 40. This developer material adhering to the sleeve 86 is commonly referred to as a magnetic brush.

The donor roll 40 includes the electrodes 42 in the form of electrical conductors positioned about the peripheral circumferential surface thereof. The electrodes are preferably positioned near the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Half of the electrodes, every other one, are electrically connected together. Collectively these electrodes are referred to as common electrodes 114. The remaining electrodes are referred to as active electrodes 112. These may be single electrodes or they may be electrically connected together into small groups. Each group is typically on the order of 1 to 4 electrodes; all groups within the donor roll having the same number of electrodes.

As discussed in detail below, the electrodes 42 are electrically biased to assist in developing toner particles 78 from the transport roll 46 to the donor roll 40, and to subsequently assist in developing toner to the photoconductor surface.

Either the whole of the donor roll 40, or at least a layer 111 thereof, is preferably of a material which has sufficient electrical conductivity so as to prevent any long term build up of electrical charge. Yet, the conductivity of this layer must be sufficiently low so as to form a blocking layer to prevent shorting or arcing of the magnet brush to the donor roll electrode members and/or donor roll core itself. Also, as discussed below, there will be an AC potential difference maintained between active electrodes 112 and the common electrodes 114 when these electrodes pass near the development nip 98. The conductivity of layer 111 must also be chosen to be sufficiently low to avoid too high a current draw between the electrodes.

Embedded within the low conductivity layer 111 are the donor roll electrodes 42. As earlier stated these electrodes may be classified as common electrodes 114 or as active electrodes 112. The common electrodes 114 are all electrically connected together. The active electrodes 112 may be electrically connected into small groups of 1 to 4 electrodes.

The development of toner from the transport roll 46 to the donor roll 40 will now be discussed. In the region 90, a commutator 101 is used to connect active electrodes 112 to the common electrodes 114 so that these will be at the same potential in the region 90. In this region, the electrodes 112 and 114 are kept at a specific voltage with respect to ground by a power supply in the form of a direct current (DC) voltage source 92. As shown in FIG. 3, a power supply in the form of an alternating current (AC) voltage source 93 may also be connected to the electrodes.

The transport roll 46 is also kept at a specific voltage with respect to ground by a power supply in the form of a DC voltage source 94. A power supply in the form of an AC voltage source 95 may also be connected to the transport roll 46. In general, what is of interest in the region 90 is the net DC potential difference and the net DC and AC potential difference between the electrodes 42 and the donor roll. The net potential difference can of course be derived through various combinations of power supplies 95, 94 and power supplies 93, 92.

By controlling the magnitudes of the DC voltage sources 92 and 94 one can control the DC electrical field created across the magnetic brush, i.e. between the donor roll surface and the surface of the rotating sleeve 86. When the electric field between these members is of the correct polarity and of sufficient magnitude, it will cause toner particles 78 to develop from the magnetic brush and form a layer of toner particles on the surface of the donor roll 40. This development will occur in what is denoted as the loading zone 90.

By controlling the magnitude and frequencies and phases of the AC voltage sources 93 and 95 one can control the AC electrical field created across the magnetic brush, i.e. between the donor roll surface and the surface of the rotating sleeve 86 of magnetic roll 46. The application of the AC electrical field across the magnetic brush is known to enhance the rate at which the toner layer develops onto the surface of the donor roll 40.

It is believed that the effect of the AC electrical field applied across the magnetic brush in the loading zone between the surface of the donor roll 40 and the rotating sleeve 86 is to loosen the adhesive and triboelectric bonds of the toner particles to the carrier beads. This in turn makes it easier for the DC electrical field to cause the migration of the toner particles from the magnetic brush to donor roll surface.

As mentioned above, in the loading zone 90 it is also desirable to connect the active electrodes 112 to the same DC and AC voltage sources as the one to which the common electrodes 114 are connected. In this case the connection in the loading zone would be to DC voltage source 92 and AC voltage source 93. This has been demonstrated to improve the efficiency with which the donor roll is loaded. The AC voltage may be a benefit to the toner reload process of reloading the donor roll 40 with the magnetic brush. It should be appreciated that the AC may also be eliminated if it is so desired.

It has been found that a value of about 200 V rms applied across the magnetic brush between the surface of the donor roll 40 and the sleeve 86 is sufficient to maximize the loading/reloading/development efficiency. That is the delivery rate of toner particles to the donor roll surface is maximized. The actual value can be adjusted empirically. In theory, the value can be any value up to the point at which arcing occurs within the magnetic brush. For typical developer materials and donor roll to transport roll spacings and material packing fractions, this maximum value is on the order of 400 V rms. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

In summary, the relative voltages between the donor roll 40, common electrodes 114, and active electrodes 112, and the sleeve 86 of magnetic roll 46 are selected to provide efficient loading of toner from the magnetic brush onto the surface of the donor roll 40. Furthermore, reloading of developer material on magnetic roll 46 is also enhanced.

Donor roll 40 rotates in the direction of arrow 91. In the development zone 98, AC and DC electrode voltage sources 96 and 97, respectively, electrically bias active electrodes 112 to a DC voltage having an AC voltage superimposed thereon.

As shown in FIG. 3, according to one aspect of the present invention, a commutator 100 contacts active electrodes 112 in the development nip 98 and is electrically connected to electrode voltage sources 96 and 97. In this way, electrical conductors 42 advance into development nip 98 as donor roll 40 rotates in the direction of arrow 91. Active electrodes 112, in development nip 98, are charged by the commutator 100 and are electrically biased by electrode voltage sources 96 and 97. Common electrodes 114 are held at a different potential derived from voltage sources 92 and 93 previously described. In this way, an AC voltage difference is applied between the active electrodes 112 and the common electrodes 114, detaching toner from the donor roll and forming a toner powder cloud.

The construction and geometry of a segmented donor roll is described in detail in U.S. Pat. No. 5,172,259 to Hays et al., U.S. Pat. No. 5,289,240 to Wayman, and U.S. Pat. No. 5,413,807 to Duggan the relevant portions thereof incorporated herein by reference.

The applicants have determined that the required potential difference between active and common electrodes for the donor roll 40 of approximately 2.5 cm. in diameter with the interdigitized common electrodes 114 and active electrodes 112 of approximately 0.004 inches wide, -spaced approximately 0.006 inches apart around the periphery of the donor roll 40, is approximately 1,300 volts peak at, for example, a 3 KHz sine wave waveform.

Figure 1:
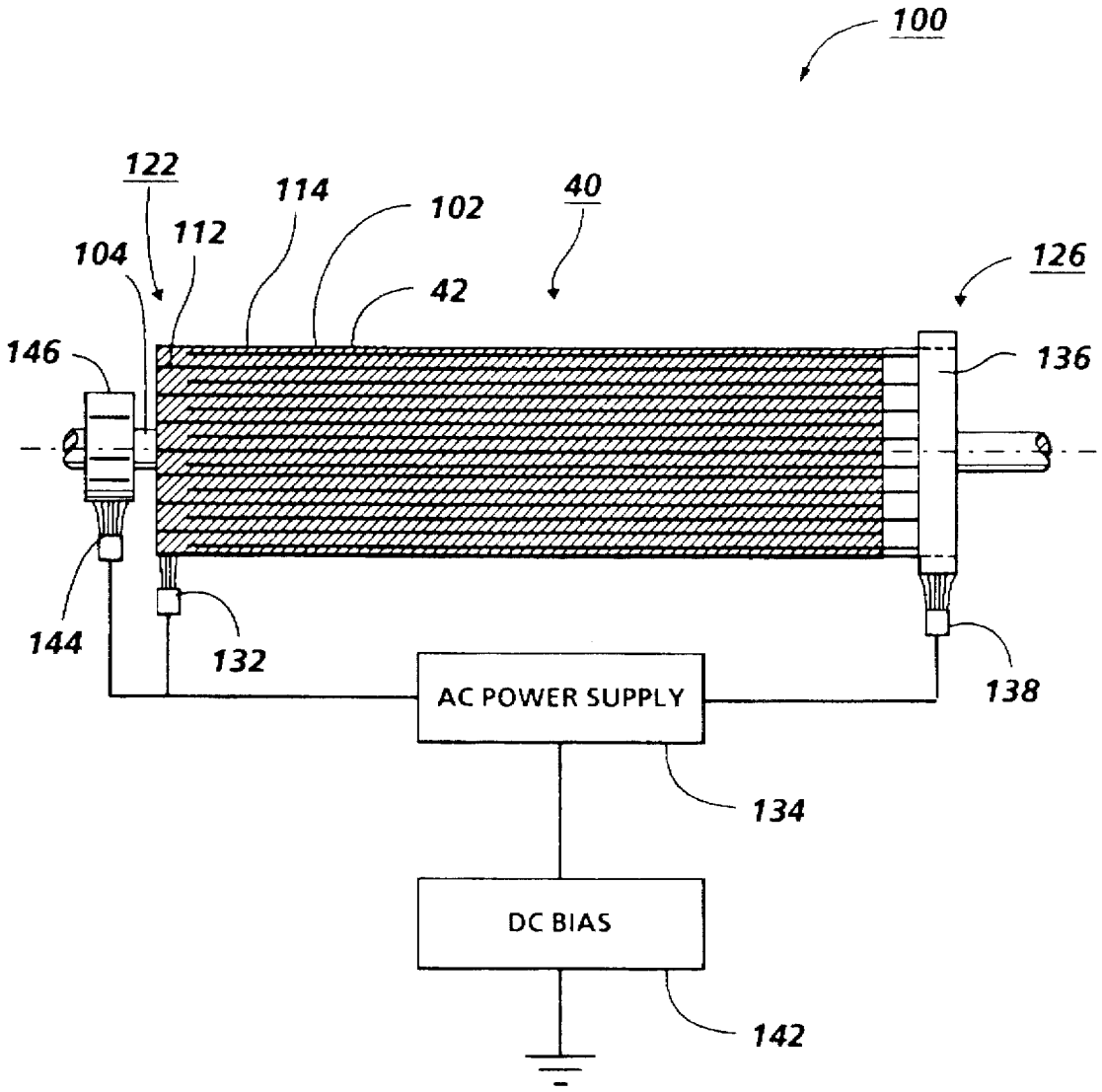
FIG. 1 is a schematic elevational view of a capacitive coupled segmented donor roll according to the present invention.

According to one embodiment of the present invention and referring to FIG. 1, a commutator 100 is shown. The donor member 40 may have any suitable shape such as a belt, but is preferably in the form of a roll. The donor roll 40 includes a body 102 which includes a electrically conductive portion.

Figure 4:
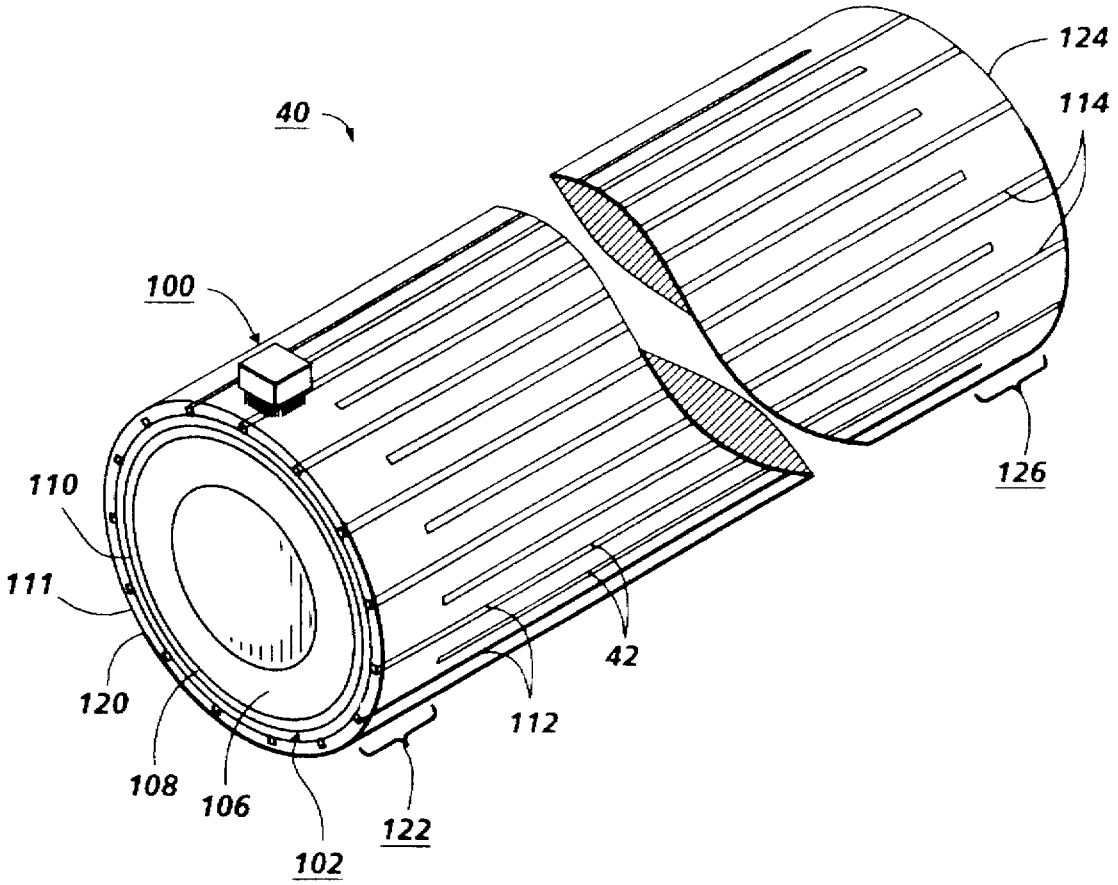
FIG. 4 is a fragmentary perspective view of the capacitive coupled segmented donor roll of FIG. 1.

For example, referring now to FIG. 4, the donor roll 40 is shown in greater detail. The donor roll 40 includes body 102 which is made of any suitable durable material and includes at least a portion of the body which is electrically conductive. For example, the body 102 as shown in FIG. 4 includes a core 106 made of any suitable durable material which may be electrically insulative or electrically conductive. The core, for example, may be made of a ceramic material or an organic material, for example, polypropelene. A conductive layer 108 is preferably applied to the core 106 on at least a portion of the core 106.

A dielectric layer 110 is applied to the conductive layer 108. The dielectric layer 110 separates conductive layer 108 from the electrodes 42. For convenience, the layer 110 will be referred to as a "dielectric layer", but this layer does not have to have ideal insulating properties. The layer can have some conductivity if first of all the resistive impedance of this "dielectric layer" between the conductive layer 108 and the electrodes 42 is much larger than the capacitive reactance of the "dielectric layer" between the conductive layer 108 and the electrodes 42. In general it is also required that the dielectric strength of the layer 110 be large enough to sustain the maximum voltage drops discussed later between the conductive layer 108 and the electrodes 42. The dielectric layer 110 may be made of any suitable durable material with the appropriate dielectric properties for example the dielectric layer 110 may be made of Teflon®, a product of DuPont (UK) Ltd., Kapton®, a product of DuPont (UK) Ltd., or a ceramic material having conductive and non-conductive materials. The dielectric layer 110 preferably has a thickness that is comparable to the distance between the active and the common electrodes, and will typically be from 0.025 mm to 0.25 mm with 0.1 mm preferred. The dielectric layer 110 preferably generates a capacitance between the active electrodes 112 and the conductive layer 110 that is comparable to the inter electrode capacitance between a set of adjacent active and common electrode pairs. Typically, this will be from 10 picofarads to 100 picofarads with 20 picofarads preferred. Electrodes 42 are positioned upon the dielectric layer 110. The electrodes 42 are preferably axially positioned about the donor roll 40 and are equally spaced from each other. The electrodes 42 preferably include two sets of electrodes, active electrodes 112 which are interdigitized or spaced between common electrodes 114. The active electrodes 112 extend outwardly from the common electrodes 114 on a first end 120 of the donor roll to form a first commutation area 122. The common electrodes 114 extend outwardly from the active electrodes 112 on a second end 124 of the donor roll to form a second commutation area 126. The charge relaxable layer 111 is preferably not applied to either the first commutation area 122 or the second commutation area 126. The charge relaxable layer 111, however, is applied to donor roll 40 between commutation area 122 and commutation area 126.

Referring again to FIG. 1, a first commutator 132, preferably in the form of a electrically conductive brush, for example, a carbon impregnated plastic brush made of pultruded fibers contacts the first commutation area 122 of the donor roll 40. The brush 132 is electrically connected to one side of the secondary of an AC power supply 134.

A slip ring 136 made of any durable conductive material, for example, brass, is fitted over the second commutation area 126 of the donor roll. A second commutator 138, preferably in the form of a brush similar to brush 132, contacts the conductive ring 136. The brush 140 is electrically connected to the other side of the secondary of AC power supply 134. A DC bias power supply 142 is connected to a central tap of the secondary of AC supply 134, as shown.

A third commutator 144 preferably in the form of a brush such as brush 132 is in contact with slip ring 146 which is positioned over shaft 104. Slip ring 146 is similar to slip ring 136. Shaft 104 is electrically connected to conductive layer 108 of donor roll 40 (see FIG. 4). The brush 144 is electrically connected to the brush 132 and to the AC power supply 134, as shown in FIG. 1. The AC power supply 134 supplies an electrical signal to brush 144 and the same electrical signal to brush 132.

Figure 5:
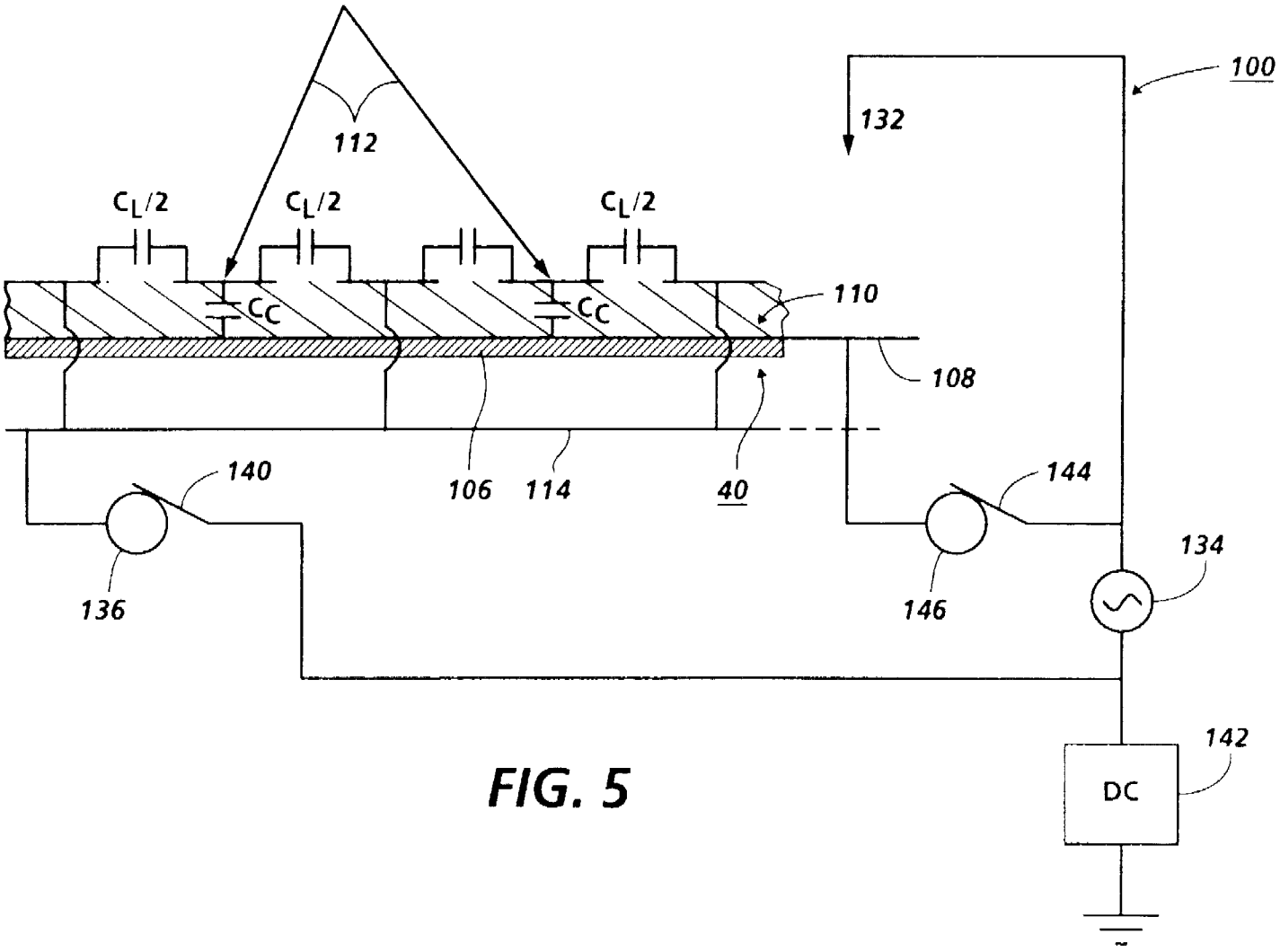
FIG. 5 is a schematic electrical diagram of the capacitive coupled segmented donor roll of FIG. 1.

Referring now to FIG. 5, the commutator 100 is shown schematically. DC bias power supply 142 is electrically connected by way of the slip ring 136 and the brush 140 to the common electrodes 114.

Although FIG. 5 shows the DC power supply 142 connected directly to the common electrodes 114 through brush 140 and slip ring 136, the DC bias could also be introduced through a tap on the output transformer of power supply 134 in order to provide some AC potential difference between the common electrodes 114 and the grounded photoconductor substrate. This can be advantageous for levitating the toner cloud closer to the photoconductor surface 12, thereby improving development of for example fine zones. This can be applied to all following drawings and discussions as well. For illustration purposes here, the direct DC connection to 140 will be discussed with the understanding that connection to a central tap on the output transformer can also be utilized in all of the discussions and illustrations used.

The active electrodes 112 are electrically commutated to the AC power supply 134 and the DC power supply 142 by way of the brush 132. The conductive layer 108 is electrically connected to the AC power supply 134 and the DC bias power supply 142 by way of the slip ring 146 and the brush 144. The dielectric layer 110 separates the conductive layer 108 from the active electrodes 112 and the common electrodes 114. The active electrodes 112 have an effective capacitance $C_c$ between these electrodes and the conductive layer 108. There is also a total inter electrode capacitance $C_L$ between the active electrode 112 and the two adjacent common electrodes 114. As discussed below, the presence of the capacitance $C_C$ formed between the active electrodes 112 and the conductive layer 108, and the bias scheme proposed, will help to reduce the voltage drop between the commutator brush 132 and the active electrodes 112 prior to actual contact of the brush to the electrodes. In this way high electrical stresses that would otherwise occur during the commutator contact can be minimized. This in turn can help to extend the life and to minimize the long term wear and failure rate of the commutator system.

While the invention may be practiced with varying values of $C_L$, preferably the capacitance $C_L$ is from 10 picofarads to 50 picofarads with 20 picofarads preferred. The capacitance $C_C$ can be easily increased or decreased in order to optimize the system for any given toner adhesion input conditions, and it should be chosen in relationship to the value chosen for $C_L$. In practice this will generally mean that the thickness of the dielectric layer 110 will be similar to the distance between the active and the common electrodes. While the invention may be practiced with varying values of $C_C$, preferably the capacitance $C_C$ is from $C_L/2$ farads to $5C_L$ farads with $C_L$ farads preferred. For example, it is desirable to minimize the voltage drop between the brush 132 and the active electrodes 112 prior to contact in order to minimize the stresses on the commutator brush system. To do this, a higher $C_C$ could be used.

Higher $C_C$ is desired to bring the AC voltage on the active electrodes closer to the voltage on the commutator brush in order to minimize the voltage drop during commutation, but too high an AC voltage on the electrodes 112 prior to the commutation region is not desired. The purpose for the AC voltage difference between the active and the common electrodes is to loosen the toner on the donor roll and to create a toner cloud. In general, it is undesirable to begin to create a toner cloud substantially prior to or very far past the region 98. Preferably, the toner cloud is generated within a small region in the development nip 98, around less than 6 mm in width in the direction shown by arrow 91 in FIG. 3. However, a higher $C_C$ will increase the AC potential difference between the active and the common electrodes prior to the development nip, and too high an AC may undesirably excite the toner prior to the desired excitation in development zone. It will typically be true that unacceptable toner excitation prior to and past the commutation zone 98 will be prevented if the value for $C_C$ is chosen to insure that the AC potential difference between the active and common electrodes is below about 1000 volt prior to the commutation region. This will depend on the toner and other materials parameters that affect toner adhesion to the donor roll surface.

It can be appreciated that the exact optimized conditions for $C_C$ will thus depend on the specific toner design. A higher value for $C_C$ can be easily obtained by extending the commutated electrode length and width on one side of the roll for more area, by choosing thinner high dielectric constant coatings for the layer 110, or by making the electrodes wider at the ends where the coatings at the ends of the roll are located. Lower values of $C_C$ can be easily obtained for example by choosing thicker, lower dielectric constant material for the layer 110. Then, by choosing the appropriate parameters involved with $C_C$, the system can be optimized for different types of toner designs. It is also noted that the AC excitation need not be a sine wave to create a toner cloud in the systems previously described. Other AC waveforms such as square wave, trapezoidal or other similar wave shapes may permit even lower peak voltages and can be used with the inventions described here.

Figure 6:
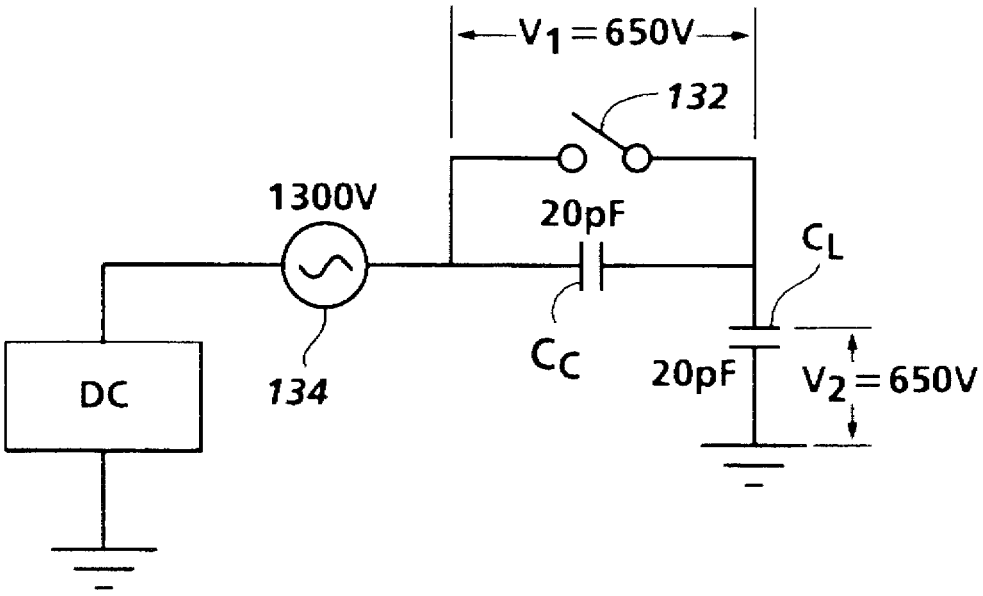
FIG. 6 is a schematic electrical diagram of the active electrodes outside the development nip of the capacitive coupled segmented donor roll of FIG. 1.

A circuit diagram illustrating the electrical circuit acting upon the active electrodes 112 which are not in contact with the brush 132 is shown in FIG. 6. Power supply 134 is coupled to ground by way of the capacitance $C_C$ of the dielectric layer 110 and the inter electrode capacitance $C_L$ of the electrodes 112. Voltage $V_1$ across the dielectric layer 110 and voltage $V_2$ across the electrodes 112 are summed to equal the voltage of the AC power supply 134. Typically, the AC power supply 134 provides a voltage of approximately 1.3 kv at a frequency of for example approximately 3 Khz and may have a sine wave form. A voltage of approximately 1 kv is required to form the powder cloud in the development nip when utilizing hybrid scavengeless development. If, for example, the capacitance $C_L$ and the capacitance $C_C$ are equal, then voltage $V_1$ across the dielectric layer 110 and voltage $V_2$ across the electrodes 112 are equal and their voltages add to the total voltage of the AC power supply 134. For a voltage of the AC power supply 134 of about 1300 volts, $V_1$ would then equal 650 volts and $V_2$ would equal 650 volts as well. The voltage $V_2$ of the non-commutated electrodes 114 would thus be approximately 650 volts, which is less than the 1000 volts required to activate a powder cloud. Note that the maximum voltage drop across the "switch" (in this case, the commutator brush 132 prior to contact with the active electrodes) is the same as the voltage drop across $C_C$, and is 650 volts in this example. If the conductive layer 108 were removed, effectively the capacitance $C_C$ would substantially go to zero and the maximum voltage drop across the "switch" would be substantially the full 1300 volts. Thus, adding the capacitance $C_C$ has reduced the voltage drop across the "switch".

Figure 7:
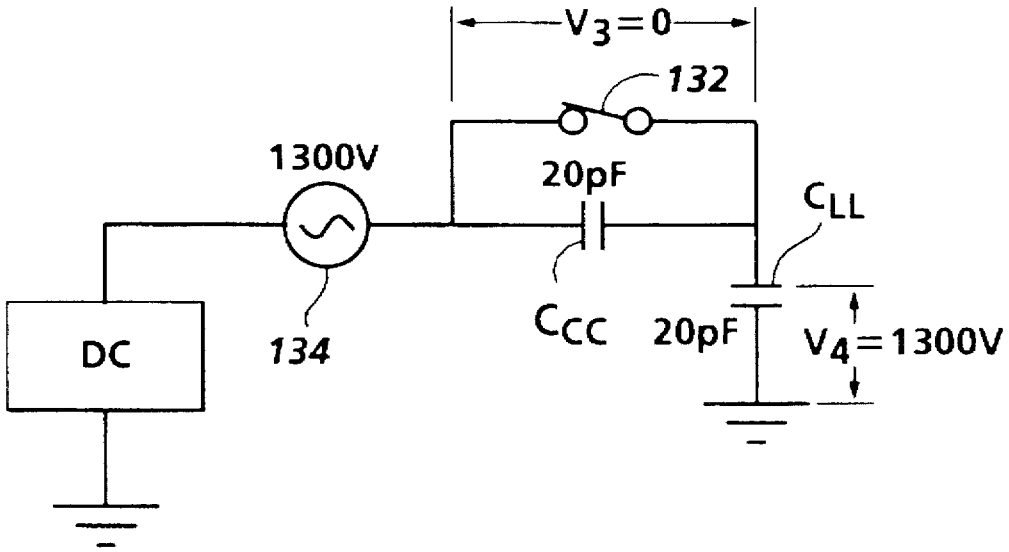
FIG. 7 is a schematic electrical diagram of the active electrodes within the development nip of the capacitive coupled segmented donor roll of FIG. 1.

Referring now to FIG. 7, a circuit diagram for the active electrodes 112 is shown. The effect of the brush 132 contacting the active electrodes 112 is to shunt the dielectric layer 110 producing voltage $V_3$ across the dielectric layer 110 equaling approximately zero and the voltage $V_4$ across the active electrodes 112 to be approximately equal to the AC bias power supply voltage.

For an AC power supply voltage of approximately 1300 volts, the voltage across the active electrodes which are in contact with the brush 132 would be likewise 1300 volts which is in excess of the 1,000 volts required for formation of a powder cloud. The active electrodes 112 which are contacted by the brush 132 thus have a voltage of approximately 1300 volts while those commutated electrodes 114 which are not in contact with the brush 132 have a voltage of approximately 650 volts. As explained, these relative voltages can be changed by altering the area and thickness of the dielectric layer 110, and the material of the dielectric layer. The electrodes which are not in contact with the brush may be made to be slightly less than 1,000 volts and the voltage for the electrodes in contact with the contact brush to be slightly greater than 1,000 volts. The voltage change across the switch during commutation will thus be minimal reducing the wear and damage on the electrode contacts and on the brush commutator materials.

Figure 8:
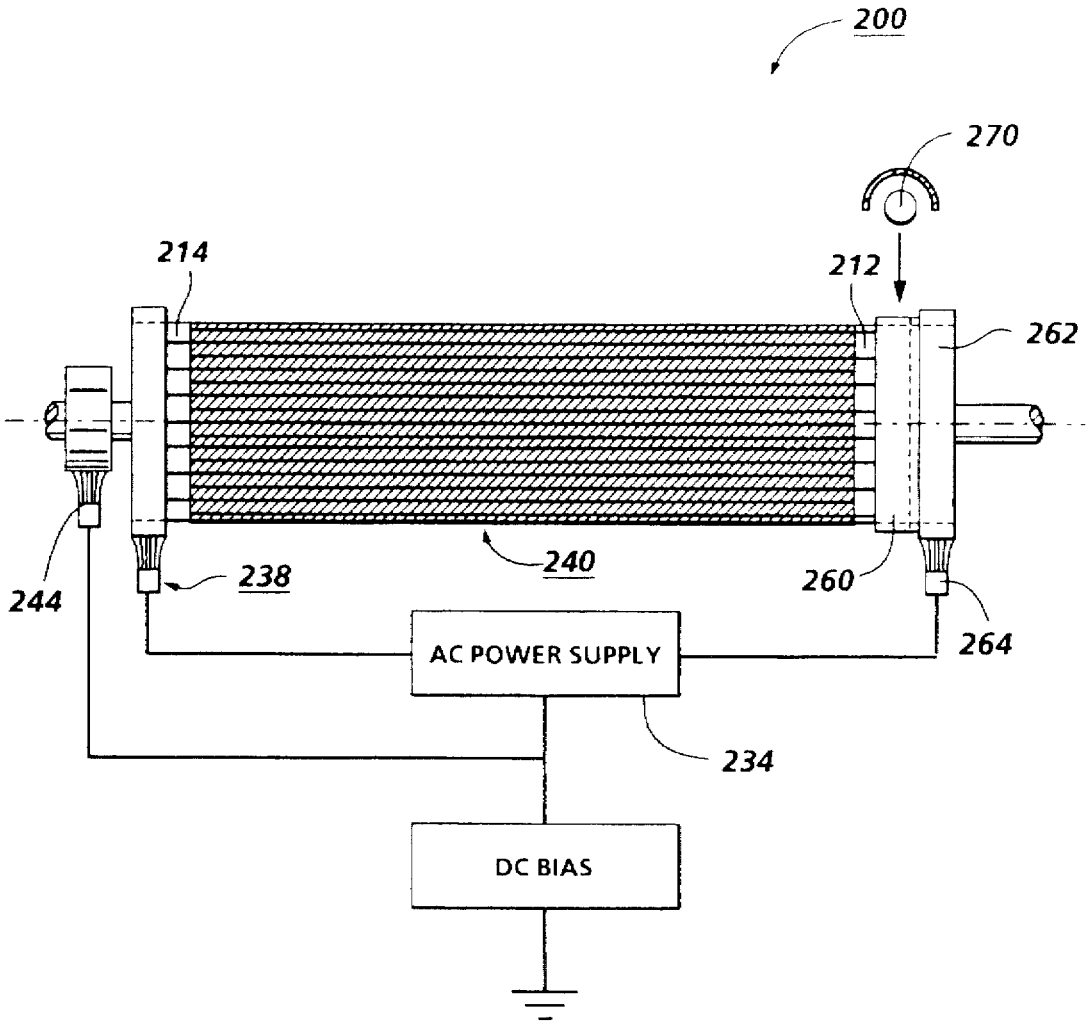
FIG. 8 is a schematic elevational view of an alternative embodiment of a capacitive coupled segmented donor roll according to the present invention also utilizing photoconductive coupling.
Figure 8A:
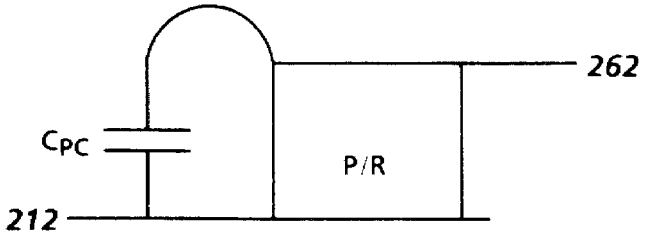
FIG. 8A is a schematic electrical representation of the photoconductive coupling of FIG. 8.

An alternate embodiment of the capacitive assisted commutation system of the present invention is shown in commutator 200 of FIG. 8. Commutator 200 is similar to commutator 100 of FIG. 1 except that brush type first commutator 132 is replaced by photoconductive ring 260 which is electrically connected to active electrodes 212. The photoconductive ring is shown in cross section in FIG. 8*a*. The photoconductive ring 260 is electrically connected to a slip ring 262. Brush 264 is in contact with the slip ring 262. The brush 264 is similar to brush 132 of FIG. 1. The brush 264 is electrically connected to AC power supply 234. Active electrodes 212 are similar to active electrodes 112 of FIG. 1. Slip ring 262 of FIG. 8 is similar to the slip rings 136 and 144 of FIG. 1. The brush 264 conveys the AC signal from the AC power supply 234 to the slip ring 262. A light source 270 is illuminated upon the photoconductive ring near the development nip 98 (see FIG. 3). The exposure to light of the photoconductive ring 260 in the area of the development nip causes that portion of the photoconductive ring 260 adjacent the nip to be electrically conductive, while the remainder of the photoconductive ring is non-conductive. The photoconductive ring has some capacitance $C_{PC}$ between the slip ring 260 and the active electrodes 212 as shown schematically in FIG. 8*a*. During light exposure, conversion to "electrically conductive" should be taken to mean that when the photoconductor is activated by light its resistive impedance is small compared to the capacitive reactance of $C_{PC}$.

The active electrodes 212 adjacent the exposed portion of the photoconductive ring and the nip receive the power from the AC power supply 234 through the slip ring 262. The non-commutated portions of the active electrodes 212 in the area away from the development nip do not receive significant light, but the AC applied to the electrodes prior to the development zone is partially coupled to the active electrodes through the capacitance $C_{PC}$. This capacitance $C_{PC}$ is in parallel with the added capacitance $C_{CC}$ discussed below. Similar to previous discussions relative to the contacting brush commutator "switch", the sum of $C_{PC}$ and $C_{CC}$ can be chosen to minimize the voltage drop across the photoconductor layer "switch" without causing unacceptably high voltage drop across the active and common electrodes to cause unwanted toner excitation prior to the development zone where the light is blocked. The commutator 200 includes a second commutator 238 similar to second commutator 138 of FIG. 1 as well as a third commutator 244 similar to the commutator 144 of FIG. 1. The use of a photoconductive ring 260 and a light source 270 is explained in greater detail in U.S. Pat. No. 5,394,225 to Parker (Prker), the relative portions thereof are incorporated herein by reference.

The commutator 200 includes a donor member preferably in the form of a donor roll 240 similar to roll 40 of FIG. 1. Roll 240 includes a body which has a conductive layer (not shown). Similar to the layer 110 in FIG. 4, a dielectric layer (not shown) is applied to at least a portion of the conductive layer. The dielectric layer separates the adjacent electrodes 42 from the conductive layer. The purpose for the dielectric layer and the conductive layer is the same as that discussed for the brush commutation system, and it is used to reduce the voltage drop across the "switch". In this embodiment, the "switch" is the photoconductive layer exposed to light. Thus, the dielectric layer thickness its capacitance will follow the same general rules previously discussed for the brush commutation system.

Figure 9:
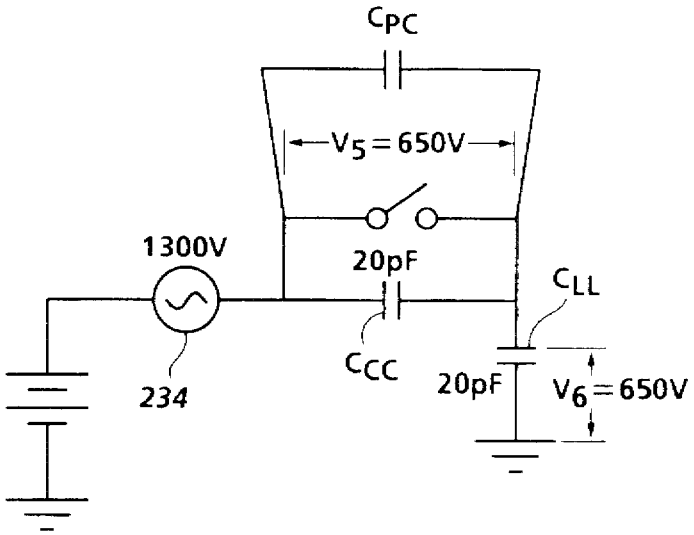
FIG. 9 is a schematic electrical diagram of the active electrodes outside the development nip of the capacitive coupled segmented donor roll of FIG. 8.
Figure 9A:
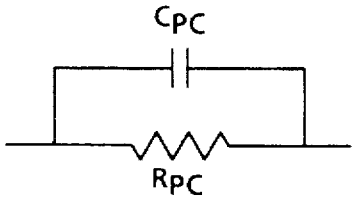
FIG. 9A is a schematic electrical representation of the photoconductive coupling of the schematic electrical diagram of FIG. 9.

FIG. 9 illustrates the circuit diagram of the AC power supply 234 upon the active electrodes 212 in the area in which the active electrodes 212 are not commutated by exposure to light. $C_{CC}$ is the capacitance of the dielectric layer, $C_{PC}$ is the capacitance of the photoconductive layer between ring 262 and the active electrodes (see FIG. 8*a*), while $C_{LL}$ is the inter electrode capacitance between the active electrodes 212 and the common electrodes 214. The capacitance $C_{CC}$ is in parallel with the capacitance $C_{PC}$. For purposes here, the sum of these two will be referred to as the capacitance $C_D$. In the dark the photoconductive material layer is chosen such that the resistive impedance $R_{PC}$ is large compared to the capacitive reactance of $C_C$ (see FIG. 9*a*). If, for example the capacitance $C_{LL}$ is approximately equal to the capacitance $C_D$, the voltage $V_5$ across the dielectric layer and the photoconductor 260 is equal to the voltage $V_6$ across the electrodes 212. The AC voltage $V_6$ across the "photoconductor switch" is therefore approximately equal to half of the voltage of the AC power supply 234. Generally, if the capacitance $C_D$ is not utilized as taught by the present invention, the capacitance $C_D$ may be small compared to $C_{LL}$, and a substantially higher maximum voltage drop will appear across the photoconductive layer 260 prior to light activation in the development zone. Thus, the capacitance $C_D$ reduces the maximum voltage drop across the "photoconductor switch" and reduces the stresses on the photoconductor.

Figure 10:
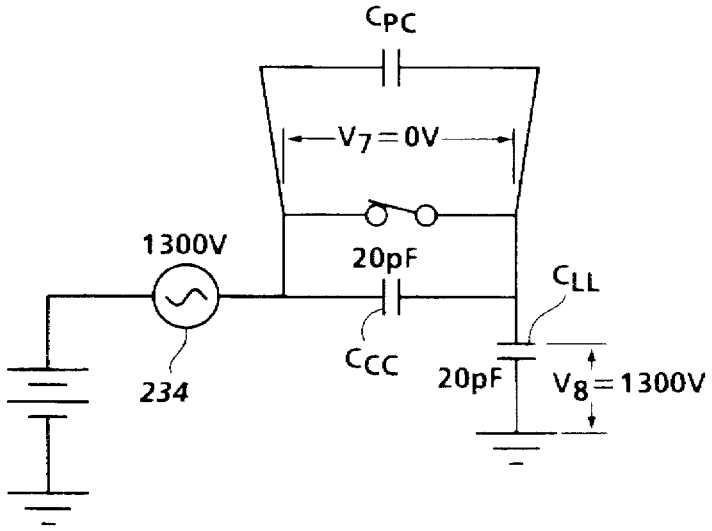
FIG. 10 is a schematic electrical diagram of the active electrodes within the development nip of the capacitive coupled segmented donor roll of FIG. 8.

Referring to FIG. 10, a circuit diagram of the AC power supply 234 upon the active electrodes 214 in the development nip is shown while the photoconductor is being activated with light in the development zone. The photoconductor is chosen so that its resistive impedance, $R_{PC}$, in the light is much smaller than the capacitive reactance of $C_D$. Light activation of the photoconductor switch in the development zone causes the voltage $V_7$ across combined capacitance $C_{CC}$+$C_{PC}$ to be approximately zero so that inter electrode voltage $V_8$ is approximately equal to the voltage of the AC power supply 234. Similar to previous discussions, the power supply 234 can utilize a square wave or alternative wave forms to further lower the peak voltages and the voltage drop across the photoconductor. Similar to previous discussions, the capacitance $C_D$ can be optimized for different systems depending on factors such as toner adhesion than may affect the thresholds for toner excitation. It will be chosen to be as high as possible to minimize the maximum voltage drop across the "photoconductor switch" in order to minimize electrical stresses on the photoconductor. It will be chosen to be low enough to cause an AC inter electrode potential below excitation levels prior to light exposure in the development nip. As discussed previously, use of thickness, dielectric constant and other approaches for the dielectric layer allows easy optimization of the capacitance $C_D$ for any system.

Figure 11:
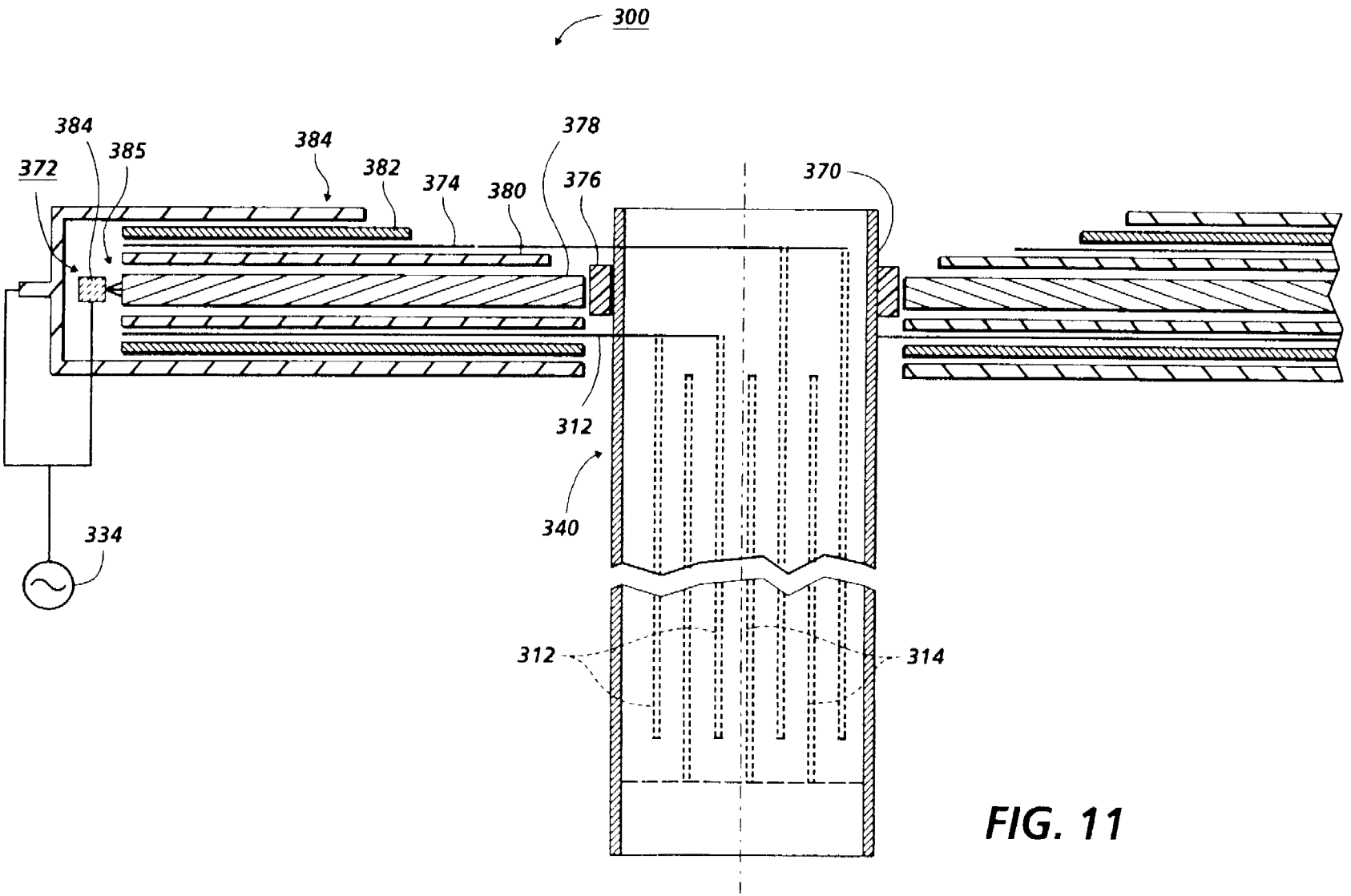
FIG. 11 is a partial schematic elevational view of an alternative embodiment of a capacitive coupled segmented donor roll according to the present invention also utilizing flanged coupling.
Figure 12:
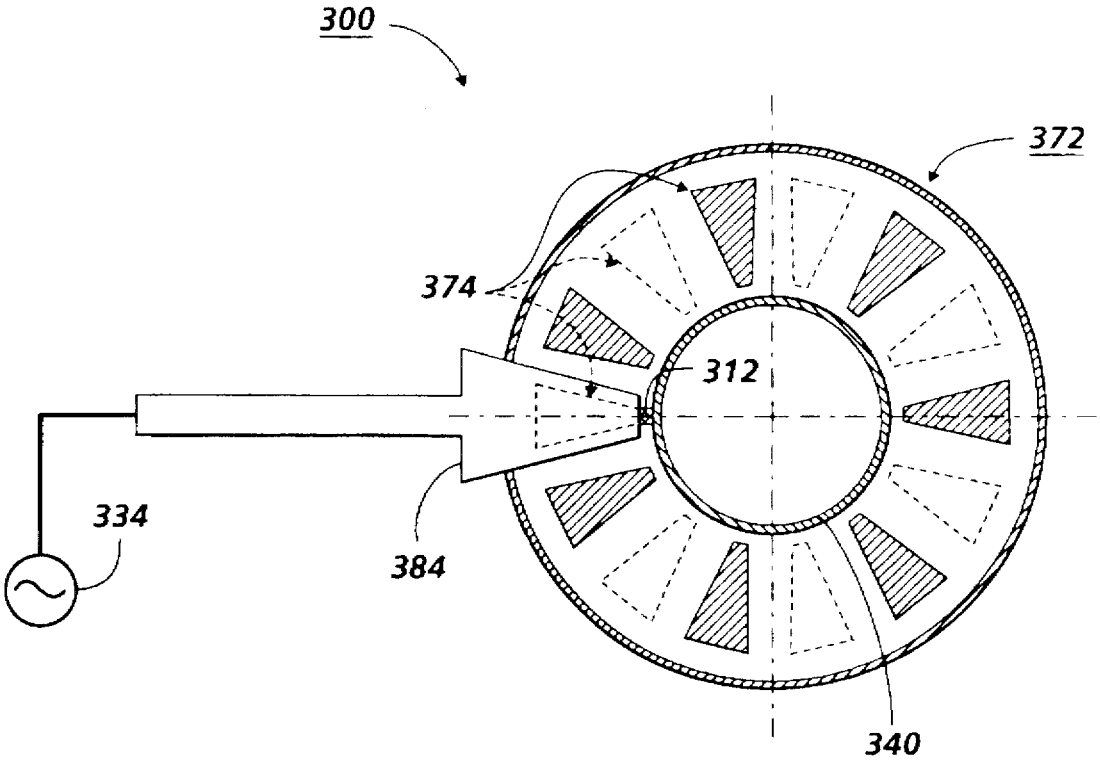
FIG. 12 is an end view of the capacitive coupled segmented donor roll of FIG. 11.

Referring now to FIGS. 11 and 12, a second alternate embodiment of the capacitive commutator of the present invention is shown. Commutator 300 includes donor roll 340 which includes a cylindrical portion 370 to which flange portion 372 is attached. Active electrodes 312 are located on the cylindrical portion 370 and are electrically connected to larger surface area foil electrode elements 374, for example, a pie shaped sector located in the flange portion 372, as shown in FIG. 12. The flange portion 372 includes an insulating hub 376 which is connected to the cylindrical portion 370. Extending outwardly from the insulating hub 376 is a metal disk 378. A dielectric layer 380 is applied to the faces of the metal disk 378. The dielectric layer 380 is made of any suitable dielectric material for example Kapton®, a product of DuPont (UK) Ltd. Located on the dielectric layer 380 are the foil electrode elements 374. The foil electrode elements 374 may be made of any suitable electrically conductive material, for example, aluminum foil or gold foil. The combination of metal disc 378, dielectric 380, and the metal foil sectors 374 form a fixed capacitor, $C_K$ for individual active electrodes. A second dielectric layer 382 is located on the other side of foil electrode elements 374. The second dielectric layer 382 may be made of any suitable material having appropriate dielectric characteristics, for example, Teflon®, a product of DuPont (UK) Ltd. In the development zone, where commutation takes place, the flange portion 372 of the donor roll 340 is surrounded by a fixed stator plate 384 made of an electrically conductive material. The fixed stator plate 384 is electrically connected to AC power supply 334. Brush 386 is electrically connected to the AC power supply 334 and is in rubbing contact with the metal disk 378 through brush 385.

Referring now to FIG. 12, the fixed stator plate 384 and the foil electrode elements 374 are shown in greater detail. The foil electrode elements 374 and the fixed stator plates 384 are in the form of a sector or segment of a circle. For a donor roll 340 having approximately 304 electrodes, 152 of the electrodes being active electrodes 312, and the remaining 152 are the common electrodes 314. One or more adjacent active electrodes may be connected together to a common foil electrode element 374. Here we will assume that two adjacent active electrodes are paired to same foil electrode. Half of the 76 active foil electrode pairs 374 are mounted on one side of flange 372 and the other half are mounted on the other side of flange 372 with adjacent foil electrodes pairs being on opposites sides of flange 372. In either case, the foil electrodes are uniformly spaced around the circumference of the flange 372.

The foils electrodes on opposite sides of the flange can overlap or be offset if so desired to obtain a controlled buildup of the AC voltage profile vs angular position of flange 372 near the development nip. A controlled buildup of the voltage profile may be beneficial in creating a stable toner aerosol cloud near and within the development zone.

Commutation is accomplished by sequentially moving the small, plate like foil electrode elements 374 past the stationary stator plates 384. This forms a capacitor, $C_T$ consisting of stator plate 384, dielectric layer 382, and the other surface of foil electrode 374. Capacitor $C_T$ is a variable capacitor, which has maximum capacitance in the commutation region where the stator plate is fully meshed with individual foil electrode plates. For individual foil electrode plates that are remote from the stator plate, $C_T$ is effectively zero. In either case, the capacitance $C_T$ is in parallel with capacitance $C_K$. The capacitance of $C_T$ and $C_K$ in parallel is the sum of their individual capacitances and will be referred to as $C_G$. $C_G$ is in series with the capacitance of the individual active electrodes 312 and the adjacent common electrodes 314.

Figure 13:
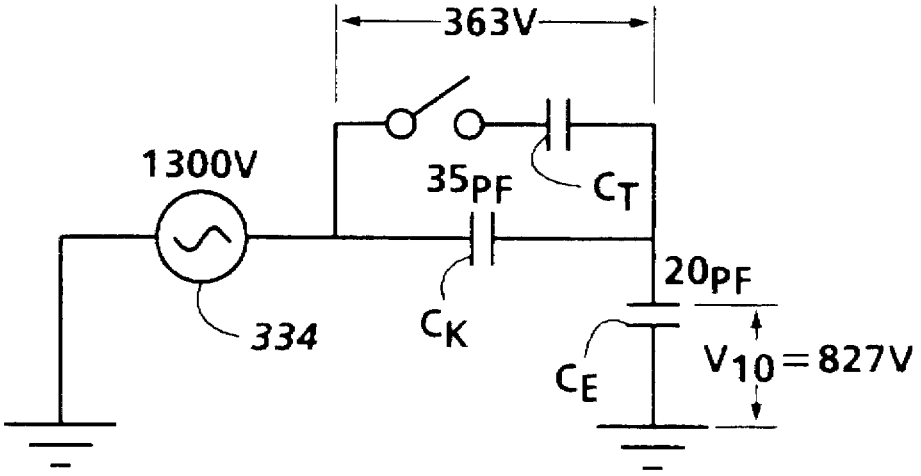
FIG. 13 is a schematic electrical diagram of the active electrodes outside the development nip of the capacitive coupled segmented donor roll of FIG. 11.
Figure 14:
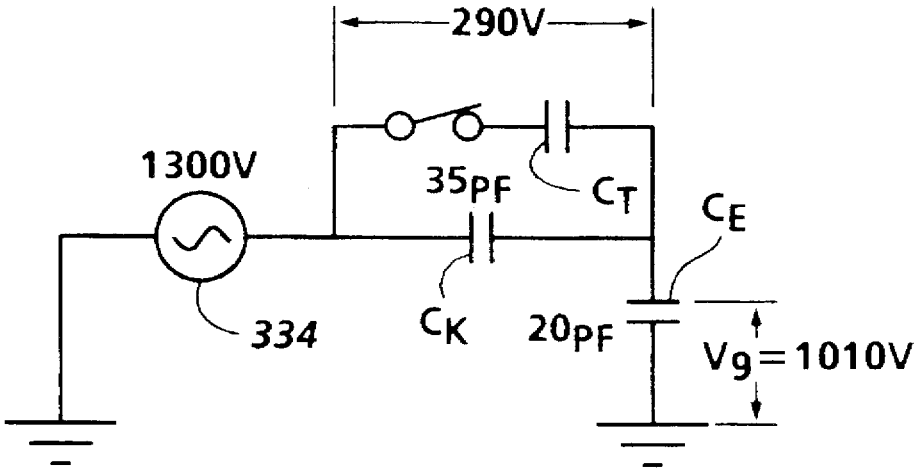
FIG. 14 is a schematic electrical diagram of the active electrodes within the development nip of the capacitive coupled segmented donor roll of FIG. 11.

An equivalent circuit for the system is shown in FIG. 13 and FIG. 14. Outside the development zone where $C_T$ is effectively zero, the AC power supply voltage will be divided across $C_K$ and $C_E$. Referring to Figure, 13 consider for example, if $C_E$ is 20 pF, and $C_K$ is 35 pf the voltage between the active and adjacent common electrodes, $V_{10}$, will be 827 volts when the peak output of the power supply 334 is 1300 volts. As discussed earlier, a voltage of 1000 volts peak is typically require to activate the toner and produce a powder cloud. Therefore outside the development zone the toner would not be activated.

In the commutation position where the stator plate is fully meshed with the foil electrode, $C_T$ is maximum, $C_G$ is also maximum and the AC voltage from power supply 334 will be divided across $C_G$ and $C_E$. For example, if the value of $C_T$ in the fully meshed position is 35 pF, and the values for $C_E$, $C_K$, and the power supply voltage are as above, the voltage $V_9$ between the active and adjacent common electrodes will be 1010 volts which is sufficient to produce a powder cloud.

It should be clear that the values of $C_T$ and $C_K$ can be manipulated by the choices dielectric material, its thickness and the capacitor's plate area. Lower voltages, $V_{10}$, prior to activation, and higher voltages, $V_9$, in the development zone can be obtained by choosing different values for $C_T$ and $C_K$.

With the proper selection of capacitance $C_T$, $C_K$, and $C_E$, voltages $V_9$ and $V_{10}$ can be selected so that voltage $V_9$ is greater than the 1,000 volts required for powder cloud formation and, outside the development zone, the voltage $V_{10}$ is slightly less than the voltage required for powder cloud formation.

The capacity, $C_C$ between the active electrodes and donor roll conductive layer 108 shown in FIG. 5 and discussed earlier could be substituted for $C_K$ or used to augment $C_K$.

It should be appreciated that the subject invention may be used in combination with resistive roller contact closures, a distributed resistive brush contact or a synchronized contact closure at or near zero voltage crossing to further reduce arcing at the commutation area.

By providing a dielectric between a first conductive portion of a donor roll and an electrode of the donor roll and by providing a electrical bias to the conductive portion of the donor roll a biased level can be applied to all electrodes. The bias electrode applied to all electrodes reduces the magnitude of the AC bias voltage that must be switched by the commutator to create a toner cloud in the development zone, thereby reducing the tendency for electrical arcing to occur during commutation.

By providing a dielectric between adjacent active electrodes, voltages applied to electrodes near the development nip may be higher than those away from the electrode nip.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A donor roll for transporting marking particles to an electrostatic latent recorded on a surface, said donor roll adaptable for use with an electric to assist in transporting the marking particles, said donor roll comprising:

a rotatably mounted body, a portion thereof being electrically conductive;

a dielectric layer mounted on a portion of the electrically conductive portion of said body;

a first electrode member, mounted on said body, adjacent said dielectric layer, and spaced from the electrically conductive portion of said body; and a second electrode member mounted on said body, adjacent said dielectric layer spaced from the electrically conductive portion of said body and spaced from said first electrode member, said dielectric layer electrically interconnecting said first electrode to said second electrode, said dielectric layer being made of a material having electrical properties thereof, the electrical properties of said being selected so that when the electric field is applied to said first electrode member a substantial portion of the field will be transferred to said second electrode member.

2. A donor roll according to claim 1, wherein:

a portion of a periphery of said body comprises the electrically conductive portion of said body; and said dielectric layer is positioned between the electrically conductive portion of said body and said electrode member.

3. A donor roll according to claim 1, wherein said body comprises an electrically insulative core with the electrically conductive portion of said body located thereon.

4. A donor roll according to claim 1, wherein said dielectric layer has a capacitance of less than 50 picofarads.

5. A donor roll according to claim 1, wherein said dielectric layer has a conductivity greater than $10^{-8}$(ohm-cm)$^{-1}$.

6. A donor roll according to claim 1, wherein said dielectric layer has a discharge time constant less than 300 microseconds.

7. A donor roll according to claim 1, wherein said dielectric layer has a thickness greater than 20 microns.

8. A donor roll according to claim 1, wherein said dielectric layer comprises a thickness approximately 25 to 250 microns.

9. A donor roll according to claim 1, wherein said roll comprises:

a first commutation area located on said body;

a second commutation area located on the periphery of said roll adjacent said first electrode member and spaced from said second electrode member; and a third commutation area located on the periphery of said roll adjacent said second electrode member.

10. A roll according to claim 1, wherein approximately at least one half of the tic field applied to said first electrode member will be transferred to said electrode member.

11. A developer unit for developing a latent image recorded on a surface of an image receiving member with marking particles to form a developed said developer unit adaptable for use with an electric field to assist in transporting the marking particles from the developer unit to said image receiving member, said developer unit comprising:

a housing defining a chamber for storing at least a supply of marking particles therein;

a movably mounted donor member spaced from the surface and adapted to transport marking particles from the chamber of said housing to a development zone the surface, said donor member including a body, at least a portion being electrically conductive, a dielectric layer mounted on a the electrically conductive portion of said body, and a first electrode member mounted on said body, adjacent said dielectric layer, and spaced from the electrically conductive portion of said body, a second electrode member mounted on said body, adjacent said dielectric layer, spaced from the electrically conductive portion of said body and spaced from said first electrode member, said dielectric layer electrically interconnecting said first electrode to said second electrode, said dielectric layer being made of a material having electrical properties thereof, the electrical properties of said being selected so that when the electric field is applied to said first electrode member a substantial portion of the field will be transferred to said second electrode member.

12. A developer unit according to claim 11, wherein:

a portion of a periphery of said body comprises the electrically conductive portion of said body; and said dielectric layer is positioned between the electrically conductive portion of said body and said electrode member.

13. A developer unit according to claim 11, wherein said body comprises an electrically insulative core with the electrically conductive portion of said body located thereon.

14. A developer unit according to claim 11, further comprising:

a power source; and an electrical contact for electrically interconnecting said power source to said electrode member.

15. A developer unit according to claim 11, wherein said dielectric layer has a capacitance of less than 50 picofarads.

16. A developer unit according to claim 11, wherein said dielectric layer has a conductivity greater than $10^{-8}$(ohm-cm)$^{-1}$.

17. A developer unit according to claim 11, wherein said dielectric layer has a discharge time constant less than 300 microseconds.

18. A developer unit according to claim 11, wherein said dielectric layer has a thickness greater than 20 microns.

19. A unit according to claim 11, wherein said dielectric layer comprises of approximately 25 to 250 microns.

20. A developer unit according to claim 11, wherein said roll comprises:

a first commutation area located on said body;

a second commutation area located on the periphery of said roll adjacent said first electrode member and spaced from said second electrode member; and a third commutation area located on the periphery of said roll adjacent said second electrode member and spaced from said first electrode member.

21. A developer unit for developing a latent image recorded on a surface of a image receiving member with marking particles to form a developed image, said developer unit adaptable for use with an electric field to assist in transporting the marking particles from the developer unit to said image receiving member, said developer unit comprising:

a housing defining a chamber for storing at least a supply of marking particles therein:

a movably mounted donor member spaced from the surface and adapted to transport marking particles from the chamber of said housing to a development zone adjacent the surface, said donor member including a body, at least a portion thereof being electrically conductive, a dielectric layer mounted on a portion of the electrically conductive portion of said body, and a first electrode member mounted on said body, adjacent said dielectric layer and spaced from the electrically conductive portion of said body so that when the electric field is applied to said first electrode member a portion of the field will be transferred to said dielectric layer;

a power source; and an electrical contact for electrically interconnecting said power source to said electrode member, said electrical contact including a first contact element electrically connected to said first electrode member and a second contact element electrically connected to said power source, spaced from said first contact element and capacitively coupled to said first contact member.

22. A developer unit according to claim 21, further comprising:

a second electrode member mounted on said body, adjacent said dielectric layer, spaced from the electrically conductive portion of said body and spaced from said first electrode member; and a third contact element electrically connected to said second electrode member.

23. An electrophotographic printing machine of the type having a developer adapted to develop with marking particles an electrostatic latent image recorded on an image receiving member, said developer unit adaptable for use with an electric field to assist in transporting the marking particles the developing unit to said image receiving member, wherein the improvement comprises:

a housing defining a chamber for storing at least a supply of marking particles therein;

a movably mounted donor member spaced from the surface and adapted to transport marking particles from the chamber of said housing to a development zone adjacent the surface, said donor member including a body, at least a portion thereof being electrically conductive, a dielectric layer mounted on a portion of the electrically conductive portion of said body, and a first electrode member mounted on said body, adjacent said dielectric layer, and spaced from the electrically conductive portion of said body, a second electrode member on said body, adjacent said dielectric layer, spaced from the electrically conductive portion of said body and spaced from said first electrode member said dielectric layer electrically interconnecting said first electrode to said second electrode, said dielectric layer being made of a material having electrical properties thereof, the electrical properties of said being selected so that when the electric field is applied to said first electrode member a substantial portion of the field will be transferred to said second electrode member.

24. A printing machine according to claim 23, wherein:

a portion of a periphery of said body comprises the electrically conductive portion of said body; and said dielectric layer is positioned between the electrically conductive portion of said body and said electrode member.

25. A printing machine according to claim 23, wherein said body comprises an electrically insulative core with the electrically conductive portion of said body located thereon.

26. A printing machine according to claim 23, further comprising:

a power source; and an electrical contact for electrically interconnecting said power source to said electrode member.

27. A printing machine according to claim 23, wherein said dielectric layer has a capacitance of less than 50 picofarads.

28. A printing machine according to claim 23, wherein said dielectric layer has a conductivity greater than $10^{-8}(\text{ohm-cm})^{-1}$.

29. A printing machine according to claim 23, wherein said dielectric layer has a discharge time constant less than 300 microseconds.

30. A printing machine according to claim 23, wherein said dielectric layer has a thickness greater than 20 microns.

31. A printing machine according to claim 23, wherein said dielectric layer comprises a thickness of approximately 25 to 250 microns.

32. A printing machine according to claim 23, wherein said roll comprises:

a first commutation area located on said body;

a second commutation area located on the periphery of said roll adjacent said first electrode member and spaced from said second electrode member; and a third commutation area located on the periphery of said roll adjacent said second electrode member and spaced from said first electrode member.

33. A printing machine according to claim 23, wherein approximately at least one half of the electric field applied to said first electrode member will be transferred to said second electrode member.

34. An electrophotographic printing machine of the type having a developer unit adapted to develop with marking particles an electrostatic latent image recorded on an image receiving member, said developer unit adaptable for use with an electric field to assist in transporting the marking particles from the developing unit to said image receiving member, wherein the improvement comprises:

a housing defining a chamber for storing at least a supply of marking particles therein;

a movably mounted donor member spaced from the surface and adapted to transport marking particles from the chamber of said housing to a development zone adjacent the surface said donor member including a body, a portion thereof being electrically conductive, a dielectric layer mounted on a portion of the electrically conductive portion of said body, and a first electrode member mounted on said body, adjacent said dielectric layer and spaced from the electrically conductive portion of said body so that when the electric field is applied to said first electrode member a portion of the field will be transferred to said dielectric layer;

a power source; and an electrical contact for electrically interconnecting said power source to said electrode member, said electrical contact including a first contact element electrically connected to said first electrode member, and a second contact element electrically connected to said power source, spaced from said first contact element and capacitively coupled to said first contact member.

* * * * *